United States Patent [19]

Brimm

[11] Patent Number: 4,725,334

[45] Date of Patent: Feb. 16, 1988

[54] METHOD OF FORMING INTEGRALLY STIFFENED STRUCTURES

[75] Inventor: Daniel J. Brimm, San Diego County, Calif.

[73] Assignee: Chem-Tronics, Inc., El Cajon, Calif.

[21] Appl. No.: 798,968

[22] Filed: Nov. 18, 1985

Related U.S. Application Data

[63] Continuation-in-part of Ser. No. 734,752, May 15, 1985, which is a continuation of Ser. No. 353,621, Dec. 18, 1981, abandoned.

[51] Int. Cl.[4] ..... C23F 1/02; B44C 1/22

[52] U.S. Cl. ..... 156/630; 156/639; 156/645; 156/651; 156/656; 156/661.1; 428/600

[58] Field of Search ..... 52/630; 428/573, 600, 428/574; 156/630, 639, 645, 651, 655, 656, 659.1, 661.1

[56] References Cited

U.S. PATENT DOCUMENTS

| | | | |
|---|---|---|---|
| 2,739,047 | 3/1956 | Sanz | 156/645 X |
| 4,137,118 | 1/1979 | Brimm | 156/661.1 X |
| 4,588,474 | 5/1986 | Gross | 156/665 X |

*Primary Examiner*—William A. Powell
*Attorney, Agent, or Firm*—Hughes & Cassidy

[57] ABSTRACT

Integrally stiffened skin structures (72, 88, 96) which can advantageously be substituted for structures of the honeycomb, skin-and-stringer, and integrally machined types. Exemplary of a virtually endless list of components in which the integrally stiffened skin structures can be employed are jet engine components, aircraft and missile fuselages, jet engine pods, aircraft landing brake components, components with compound curvatures such as bulkheads and fairings, flat and curved panels, and conical and other shell-like components. Materials from which the structures can be fabricated include stainless steels, superalloys, titanium and aluminum alloys, other metals, and a variety of composites including those advanced ones with a high strength-to-weight ratio. Novel features of the structures include: secondary ribs (74) for raising resonant frequencies and increasing structural stability with a minimum increase in weight; tapered ribs (98) which provide a significant weight reduction without unduly affecting their performance; and the elimination of node material. That provides an additional, significant weight reduction.

24 Claims, 14 Drawing Figures

Fig. 8
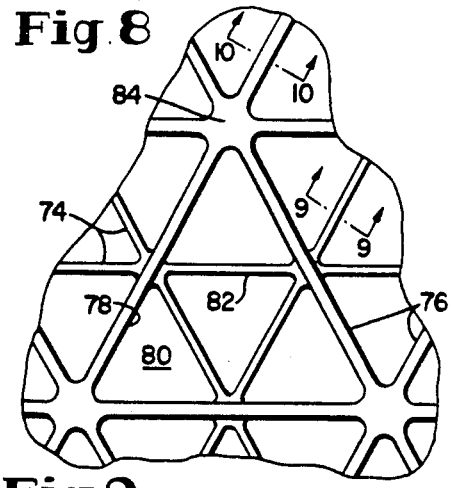
Fig. 11
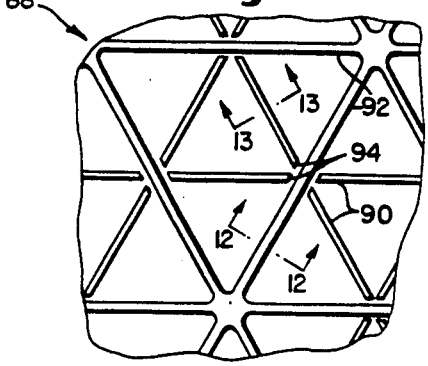
Fig. 12
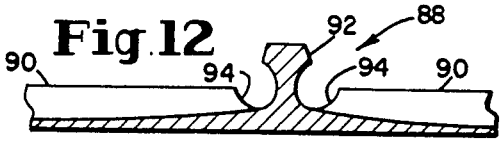
Fig. 9
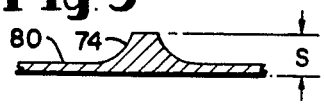
Fig. 10
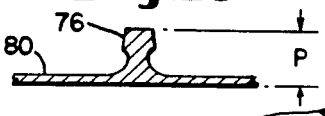
Fig. 13
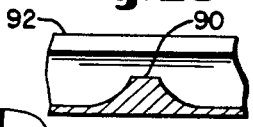
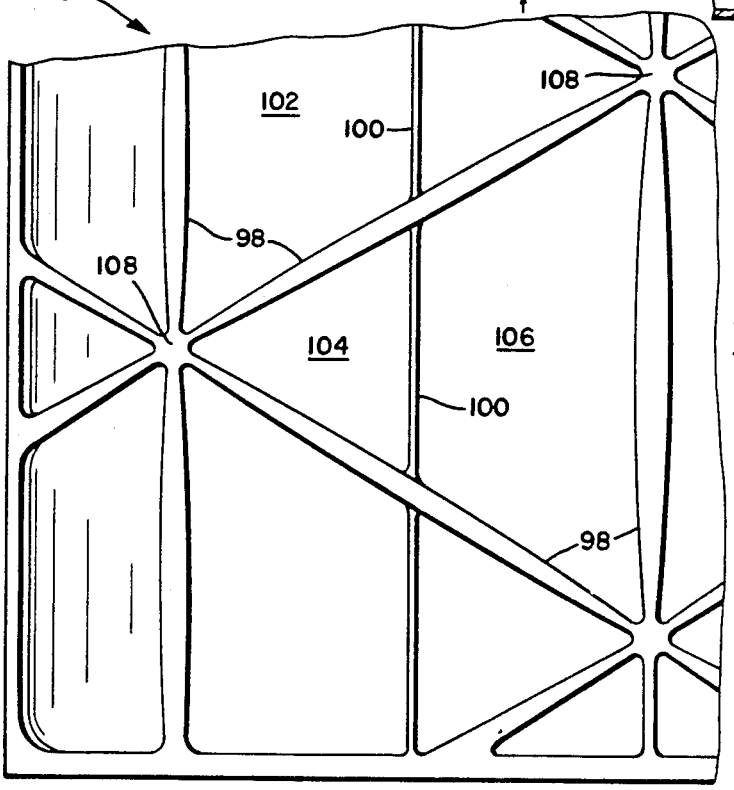
Fig. 14

METHOD OF FORMING INTEGRALLY STIFFENED STRUCTURES

RELATION TO OTHER APPLICATIONS

This application is a continuation-in-part of application No. 734,752 filed May 15, 1985. The latter is a continuation of application No. 353,621 dated Dec. 18, 1981 (now abandoned).

TECHNICAL FIELD OF THE INVENTION

The present invention relates to novel, lightweight structures composed of a skin stiffened with integral reinforcing ribs.

BACKGROUND OF THE INVENTION

My previous patents Nos. 4,113,549 issued Sept. 12, 1978, and 4,137,118 issued Jan. 30, 1979, disclose structures of the character described above in which the integral reinforcing ribs are undercut to an I-section to produce maximum efficiency in terms of section modulus and to produce a high strength to weight ratio. Because of ease of fabrication, superior performance, and other attributes, those structures can advantageously be substituted for structures of honeycomb, skin-and-stringer, and integrally machined type.

In certain cases—for example, jet engine compressor housings—structures of the character disclosed in the foregoing patents tend to be resonant at undesirable frequencies in the thin skin areas between the integral reinforcing ribs. Heretofore, these vibrations have been damped or suppressed with various compliant, energy absorbing materials. This solution is undesirable, however, as the energy absorbing material increases both the weight and the cost of the component.

SUMMARY OF THE INVENTION

I have now found that this use of energy absorbing material is unnecessary and can be eliminated by adding an array of integral, secondary, standing ribs to the structure in an appropriate pattern. This raises the resonant frequencies of the skin to levels where resonance no longer poses a problem. Furthermore, the secondary ribs significantly reduce any tendency toward elastic buckling of the skin and otherwise make the structure more stable. All of this is accomplished, moreover, with a much smaller increase in weight than would be possible if the obvious alternative solution of more closely spacing the I-sectioned ribs of my previously disclosed integrally stiffened skin structures were used. That is, the secondary ribs permit an increased, weight saving spacing of the primary ribs to be employed.

The secondary ribs can be advantageously spaced between and oriented parallel to primary ribs of the reinforcing system.

Also, I have found that those previously disclosed structures can, advantageously, be made significantly lighter without unduly impairing their performance and that the increase in weight attributable to the use of secondary ribs can, as just discussed, be offset by substituting tapered ribs for those of uniform width I heretofore employed. These tapered ribs, which decrease in width from midspan toward, and to, their ends, in effect provide an elimination of metal which does not have optimal performance.

Preferably, the cross sectional area of the tapered reinforcing rib is kept constant throughout its length to provide maximum tensile strength. This can be done by transitioning the cross section of the ribs from an I (or other capped) configuration at the midspan to a rectangular configuration at the ends of the rib.

Still another technique that I can employ to advantage to reduce the weight of my previously disclosed, integrally reinforced skin structures is to mechanically remove metal from the structure in the vicinity of the nodes where ribs meet. Again, this more than offsets any sacrifice in performance the removal of the metal may entail.

I pointed out above that a combination of the novel features disclosed herein--e.g., secondary, and tapered primary, ribs--can be employed to advantage in applying the principles of my invention. It will be apparent to those skilled in the arts to which this invention relates that still other combinations of those features can also be advantageously employed, depending upon the application made of the invention.

As indicated above, the principles of the present invention can be employed to an advantage in the manufacture of jet engine compressor housings. Exemplary of a virtually endless list of other structures that can be advantageously made by using those techniques are other cylindrical jet engine components, aircraft and missile fuselages, jet engine pods, aircraft landing brake components, components with compound curvatures such as bulkheads and fairings, flat and curved panels, and conical and other shell-like components.

Typically, the structures will be fabricated of a stainless steel, a superalloy, or a titanium or aluminum alloy. However, they can also be made from other metals and from boron/aluminum, graphite/epoxy, graphite/polyimide and other composites, preferably those advanced ones with a high strength-to-weight ratio.

Various rib patterns can be employed in the practice of the present invention. Perhaps the most commonly useful of these are the waffle (or rectangular) and geodetic (or triangular) patterns.

OBJECTS OF THE INVENTION

From the foregoing it will be apparent to the reader that one important and primary object of the present invention resides in the provision of novel, improved structures composed of a skin and at least an array of primary, integral reinforcing ribs.

Other more specific but nevertheless important objects of my invention reside in the provision of structures as characterized in the preceding object:

which have a high strength-to-weight ratio and optimum structural performance;

which are easily fabricated;

which are integrally damped and consequently not troubled by resonance at undesirable frequencies;

which can have a wide variety of shapes including those with compound curvature and can be made from a wide variety of materials;

which can be advantageously substituted for structures made by such conventional techniques as honeycomb and skin-and-stringer;

which contain a minimum of non-optimum material;

which can be produced with integral attachment features such as pads and bosses;

which are readily inspectable, easy to repair, and readily amendable to design changes;

in which significant weight savings are realized by employing one or more of the following techniques: (a) incorporating an array of secondary, integral reinforcing ribs into the structure to increase the spacing between the primary reinforcing ribs; (b) so incorporating an array of secondary, integral reinforcing ribs into the structure that the secondary ribs are spaced midway between and parallel to, primary ribs; (c) employing primary ribs of constant cross sectional area which transition from a capped, cross sectional configuration at midspan to a rectangular cross sectional configuration at the ends of the rib; (d) employing primary ribs which taper from midspan toward, and to, the ends of the ribs; (e) removing material of which the structure is formed from nodes formed by the intersections of primary ribs and/or primary and secondary ribs; and (f) removing metal formed by the intersections of primary ribs.

Still another important, and primary, object of my invention resides in the provision of methods for manufacturing structures with the characteristics and attributes identified in the preceding objects.

Other important objects and advantages and additional features of my invention will become apparent from the foregoing, from the appended claims, and from the ensuing detailed description and discussion of the invention taken in conjunction with the accompanying drawing.

BRIEF DESCRIPTION OF THE DRAWING

In the drawing:

FIG. 8 is a fragmentary plan view of the novel and improved integral reinforcing and stiffening stratagem utilized in the compressor case of FIG. 7;

FIG. 9 is a section, taken substantially along line 9—9 of FIG. 8, through a secondary rib of the integral reinforcing shown in FIG. 6;

FIG. 10 is a section, taken substantially along line 10—10 of FIG. 8, through a primary rib of the integral reinforcing shown in FIG. 8;

FIG. 11 is a partial plan view, similar to FIGS. 2 and 8, of a structure with a second, integral, stiffening and reinforcing stratagem which embodies the principles of the present invention and which involves the removal of material that does not optimally contribute to the performance of the stiffening and reinforcing system;

FIG. 12 is a section through the structure of FIG. 11 taken substantially along line 12—12 of FIG. 11 and showing where non-optimum metal can be removed from the structure;

FIG. 13 is a section through the structure of FIG. 11 taken substantially along line 13—13 of that figure and also showing where non-optimum metal can be removed from the structure; and FIG. 14 is a view, similar to FIGS. 2 and 11, of a third integral, stiffening and reinforcing stratagem which embodies the principles of the present invention and which involves the use of tapered ribs to reduce weight without unduly impairing structural performance.

DETAILED DESCRIPTION OF PREFERRED EMBODIMENTS OF THE INVENTION

Figure 1:
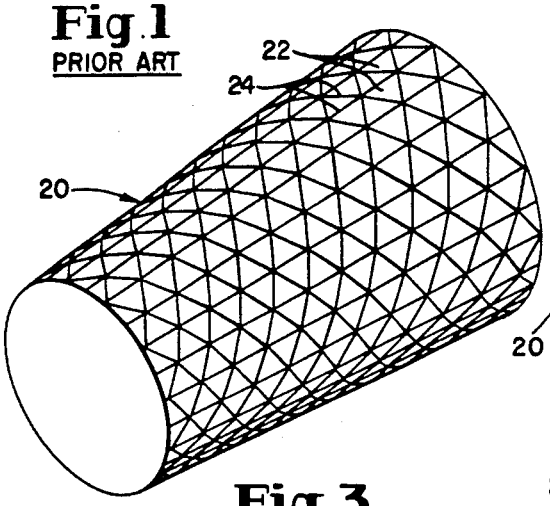
Fig. 1 PRIOR ART
FIG. 1 is a schematic view of a jet engine compressor case which has an integrally stiffened skin structure produced by the chemical milling process disclosed in my U.S. Pat. No. 4,113,549.

Referring now to the drawing, FIG. 1 depicts a jet engine fan case 20 of the character described in my earlier issued Pat. Nos. 4,113,549 and 4,137,118.

Figure 2:
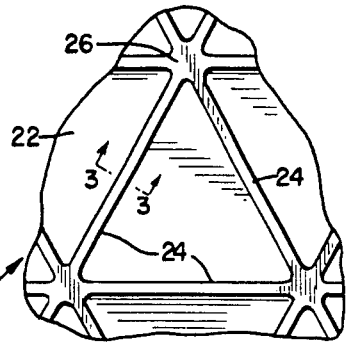
Fig. 2 PRIOR ART
FIG. 2 is a fragmentary plan view of the compressor case showing one, exemplary triangular reinforcing pattern.
Figure 3:
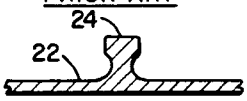
Fig. 3 PRIOR ART
FIG. 3 is a transverse section through one exemplary reinforcing rib or stiffener of the reinforcing structure.

As is best shown in FIGS. 2 and 3, fan case 20 consists of a skin 22 stiffened with integral, capped reinforcing ribs 24. The latter are arranged in a triangular or geodetic pattern. Ribs 24 intersect at nodes 26, and they have a section which approximates that of an I-beam (see FIG. 3).

Figure 4:
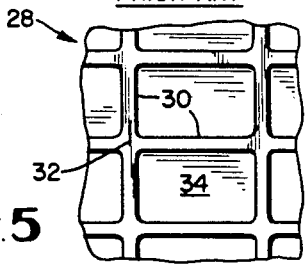
Fig. 4 PRIOR ART
FIG. 4 is a view similar to FIG. 3 of a second, rectangular or waffle pattern of integral reinforcing ribs that can be produced by the process described in U.S. Pat. No. 4,113,549.

Alternatively, the reinforcing ribs can be arranged in a rectangular or waffle pattern. A structure of that character is illustrated in FIG. 4 and identified by reference character 28. The ribs 30 of structure 28 intersect in nodes 32, and they surround pockets 34 of thin skin stiffened by the reinforcing ribs.

One actual jet engine fan case of the type just described with a waffle type pattern of reinforcing ribs has an overall length of 45.07 inches, and it is 40.98 and 50.04 inches in diameter at its opposite ends. That fan case was fabricated from 0.312 inch thick Ti6A14V titanium alloy.

The pockets surrounded by the ribs are nominally 1.70 by 6.00 inches. The rib caps are 0.150 inch wide, and the skin is 0.030 inch thick. The manufacturing tolerances are: ±0.030 inch on cap width and ±0.010 inch for skin thickness.

Figure 5:
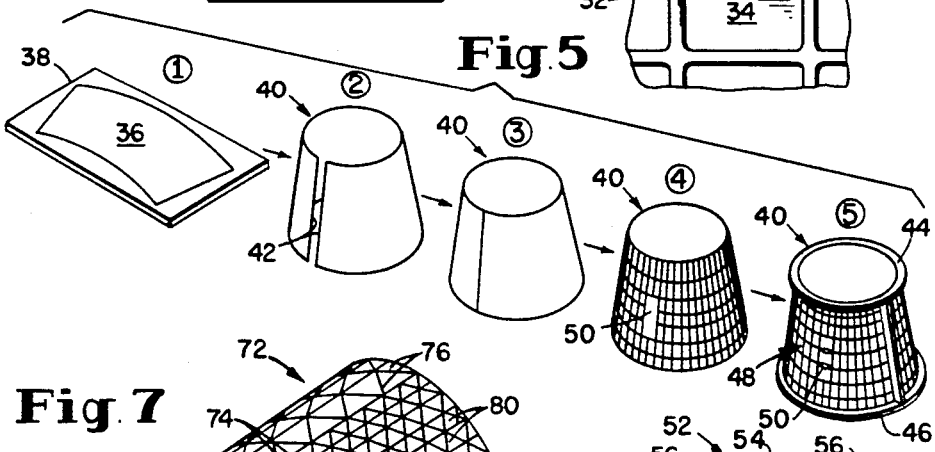
FIG. 5 illustrates, pictorially, the steps involved in fabricating a compressor case of the character shown in FIG. 1.

A typical manufacturing sequence for a jet engine fan case such as that just described is illustrated in FIG. 5.

First, a flat blank 36 is made from the plate stock 38 as by plasma cutting, saw cutting, or chemical blanking, for example. This blank is then roll formed into a conical shell 40 as indicated at "2", and the edges 42 of the shell are joined together—by electron beam welding, for example—as indicated at "3" in FIG. 5. The basic structure is then completed by sizing and trimming shell 40 to final length.

Next, the plate material is reduced to a thin skin with integral reinforcing ribs of the character described above as indicated at "4". Finally, flanges such as those identified by reference characters at 44 and 46 "5" are welded to shell 40; and the structure is then resized, stress relieved, and subjected to whatever final machining may be necessary, producing the completed fan case indentified by reference character 48.

One of the important practical features of my invention is that attachment features such as pads and bosses can be formed integrally and at the same time as the reinforcing ribs. An exemplary pad of this character, and identified by reference character 50, is shown before and after final machining at "4" and "5" of FIG. 5, respectively.

Figure 6:
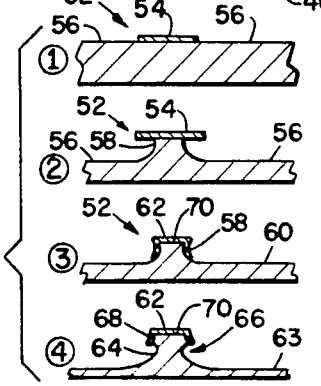
FIG. 6 shows, pictorially, the steps involved in generating the ribs of the integral reinforcing and the skin of a structure of the type of concern herein from plate stock.

Referring now to FIG. 6, the first step in reducing the plate stock of a structure such as the shell identified by reference character 40 in FIG. 5 to a thin skin reinforced by integral, I-sectioned ribs or stiffeners as discussed above in conjunction with FIGS. 2-4 is to completely mask the structure (identified by reference character 52 in FIG. 6). Masking with photoresists or other techniques can be employed for that purpose. For example, the workpiece can be coated with a suitable vinyl maskant.

As vinyl and other masking materials are commercially available and described in U.S. Pat. No. 3,380,863 issued April 30, 1968, to Silberberg and elsewhere in the literature, I do not deem it necessary to describe the masking material herein in detail. Nor do I consider it necessary to describe how the masking material is applied as brushing, spraying, and dipping tehcniques for such materials are also well known.

The next step is to strip the mask 54 from those areas 56 of structure 52 where metal is to be removed. At the end of this step the structure will appear as shown at "1" in FIG. 6.

Next, structure 52 is installed in an etch fixture, preferably of the character disclosed in my earlier issued patents, and immersed in a bath of etching solution.

The composition of the etching solution is not part of my invention. Suitable compositions are described in, for example, U.S. Patent Nos. 3,039,909 issued June 19, 1962, to DeLong et al.; 3,061,494 issued Oct. 30, 1962, to Snyder et al.; 3,108,919 issued Oct. 29, 1963, to Bowman et al.; 3,134,702 issued May 26, 1964, to DeLong et al.; and 3,745,079 issued July 10, 1973, to Cowles et al.

The parameters involved in the etching step such as concentration of active agent, temperature, etching rate, etc., will vary from application-to-application of my invention. Because of this and because the literature is replete with information from which these parameters can be readily determined for any specific application (see, for example, METALS HANDBOOK (8th Ed.), American Society for Metals, Metals Park, Ohio, 1967, Vol. III, pp. 240-249) they, likewise, will not be discussed herein.

At the end of the etching step, the fixture and structure 52 are withdrawn from the etching solution; and the mask 54 is stripped away (optionally, before stripping away the mask, the workpiece may be washed to remove the last vestiges of the active etching agent and/or pickled or surface treated, for example. Again, these are techniques well known in the chemical milling art).

At this stage, structure 52 will have the configuration shown at "2" in FIG. 6. The exposed areas 56 have been reduced approximately 50 percent in thickness, leaving ribs 58 with an uncapped, essentially rectangular cross-section in the areas protected by mask 54.

At this stage in my process structure 52 has a substantially less than optimum strength-to-weight ratio. This ratio is materially increased by further metal removal.

Specifically, the next step in my process is to remask the outer surface 60 of structure 52. The same masking material and application technique employed in the first masking step may be used. Then, the second mask 62 is stripped away from those areas of the structure where the removal of additional metal is wanted (see "3" of FIG. 6).

For example, in the exemplary application of my invention under discussion, the masking material is stripped from areas generally coincidental with the originally exposed areas 56 so that the thickness of the original stock in these areas will be further reduced to form skin 63. Also, the masking material is stripped from those parts of rectangularly sectioned ribs 58 which will become the webs 64 of the ultimately formed, capped, I-sectioned ribs 66 (see "4" of FIG. 6), leaving only what will be the flanges 68 of ribs 66 and the tops 70 of ribs 58 covered and protected from chemical attack.

After mask 62 is selectively stripped away, the workpiece is again installed in the etching fixture and immersed in an etching solution which may be identical to that used in the first etching step. At the end of this step, the fixture and component are withdrawn from the etching solution; and mask 62 is stripped from the workpiece, optionally first washing and/or otherwise treating the workpiece as described above.

The stripping away of mask 62 completes the process. At this stage structure 52 has the skin and integral, I-sectioned rib or stiffener configuration shown at "4" in FIG. 6.

One significant feature of the chemical milling process just described is that it leaves fillets between the ribs and the skin of the stiffened and reinforced structure which are approximately half the rib height in the case of capped ribs and have a general transition between the ribs and the skin. Consequentially, there are no abrupt changes in cross-section anywhere in the structure, eliminating the stress concentrations associated with the foregoing.

Figure 7:
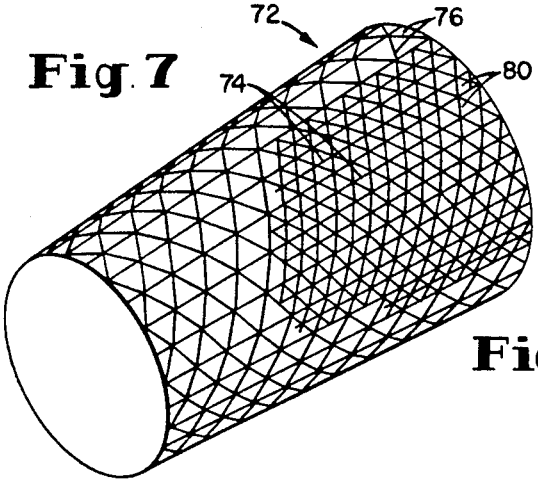
FIG. 7 is a view similar to FIG. 1 of a jet engine compressor case which has a novel, improved, integrally stiffened skin structure employing, and manufactured in accord with, the principles of the present invention.

I pointed out above that structures of the character just described may have a tendency for resonate vibrations to develop in those thin skinned portions of the structure between the integral reinforcing ribs. FIG. 7 of the drawing pictorially depicts a jet engine fan casing 72 which differs from the prior art fan casing 20 illustrated in FIGS. 1-3 in that a triangular or geodetic pattern of secondary reinforcing ribs 74 (see also FIG. 8) has been added to the basic structure to raise its resonant skin frequencies above the range in which resonant vibrations pose a problem and to reduce the weight of the casing by increasing the spacing between primary reinforcing ribs 76 (see FIG. 10).

The secondary ribs 74 of fan case 72 will typically have a rectangular or other uncapped cross section as shown in FIG. 9 whereas the primary reinforcing ribs 76 (see FIG. 10) will instead have an "I" or other capped section like the integral ribs 24 of fan case 20. The rectangular section is preferably employed only in smaller, secondary reinforcing ribs. While it is simpler to produce than the I-section, it is also less structurally efficient because of its larger skin-to-rib blend radius.

The height "S" of the secondary ribs will typically be about one-third the height "P" of the primary ribs in structures manufactured in accord with principles of the present invention. However, this is not always the case; and the height "S" of the secondary ribs may range from one-tenth to one-half of the primary height "P".

As shown in FIG. 8, the uncapped secondary ribs of a structure employing both primary and secondary rib patterns will typically be spaced midway between, and parallel to, the primary ribs. Consequently, in the case of fan case 72, for example, each of the pockets 78 of skin 80 defined by the primary ribs 76 is replaced by four pockets 82, each having one-fourth the area of the primary rib bounded pockets they replace. This raises the fundamental resonant frequencies of the skin 80, provides a weight advantage over the prior art structure shown in FIG. 1, reduces any tendency to buckling the skin may have, and otherwise makes the structure more stable. In this regard, the added weight attributable to the secondary ribs is more than offset by the greater spacing between the nodes 84 of the primary ribs 76 that the use of the secondary reinforcing ribs 74 permits. At the same time, for an equivalent weight and skin thickness, this novel construction is capable of increasing the resonant frequency of the skin of a structure of the character disclosed herein by as much as 50 to 100 percent.

The basic shell of fan case 72 can be made, for example, by the typical manufacturing sequence discussed above and illustrated in FIG. 5. The plate stock from which the basic shell is fabricated in this sequence can then be reduced to the thin skin 80 and primary ribs 76 generated by the two-step chemical milling process described above in conjunction with FIG. 6. Secondary ribs 74 are generated in the second of the chemical milling steps by the same selective masking and chemical etching sequence as is used in generating the primary ribs.

Attachment features such as pads or bosses can be generated in the basic shell of the structure being fabricated at the same time that the ribs are generated and by the same chemical milling process.

In one particular structure of the type just discussed and illustrated in FIGS. 7–10, the fan case was again fabricated from 0.312 inch thick Ti6A14V titanium alloy. The height "P" of primary ribs 76 was 0.312 inch. The nodes 84 at the intersections of the primary ribs were five inches apart, and the height of the secondary ribs 74 spaced midway between the primary ribs was 0.110 inch.

As discussed briefly above, another feature of my invention resides in the removal of the plate stock material from the nodes or intersections of the primary and secondary reinforcing ribs in a structure such as that shown in FIG. 8 in which those nodes are identified by reference character 84. A structure comparable to fan case 72 in which this has been done is illustrated in FIGS. 11–13 and identified by reference character 88.

The eliminated material is non-optimum as far as its contribution to the performance of the structure is concerned. Therefore, by removing it, a worthwhile weight saving can be realized with no appreciable sacrifice in the performance of the structure.

If the height of the secondary ribs 90 in a structure such as that shown in FIGS. 11–13 is significantly less than one-half the height of primary ribs 92, the non-optimum material can be removed in the second step of the two-step chemical milling process discussed above in conjunction with FIG. 5. Otherwise, a third masking, stripping, and etching sequence is employed to remove the non-optimum material.

The areas in which this material is cut away are shown in FIG. 12 as well as in FIG. 11, and they are identified by reference character 94. Again, the transitions are gentle; and stress concentrations are therefore avoided.

Yet another important feature of the present invention, also discussed briefly above, is the substitution of tapered ribs for those of uniform width shown in FIGS. 2 and 8 and identified by reference characters 24 and 76, for example. This innovation can be utilized to significantly reduce the weight of a rib reinforced skin structure as disclosed herein without unduly impairing its structural performance by effecting a worthwhile reduction in the amount of metal present in the nodes at the intersections of the integral, reinforcing ribs.

A structure of the character just described, and embodying the principles of this present invention, is illustrated in FIG. 14 and identified by reference character 96.

Structure 96 is, generally, of the same character as those described above. It has a triangular pattern of: (a) tapered, integral, primary reinforcing ribs 98; (b) parallel, integral, secondary reinforcing ribs 100; and (c) a thin skin 102 in triangular and trapezoidal pockets 104 and 106 bounded by the primary and secondary ribs.

As indicated above, structure 96 however differs from those previously discussed by the presence of tapered primary ribs 98. As shown in FIG. 14, those ribs are widest at midspan and narrowest at the ends of the ribs. And, as can be readily seen by comparing FIG. 14 with FIGS. 2 and 8, the result is nodes 108 which are much smaller than the nodes 26 and 84 at the intersections of fan case reinforcing ribs 24 and 76, therefore, contain significantly less material.

The advantages of tapered ribs 98 can be capitalized upon to a maximum extent by keeping the cross sectional area of the ribs generally constant over their entire length. This can be accomplished by transitioning the section of those ribs from an I-section such as shown in FIG. 10 at the midspan of the rib to the generally rectangular section shown in FIG. 9 at the ends of the rib.

Still other measures may be taken to reduce the weight of structures employing the principles of my invention where economically warranted. For example, the material at the centers of the nodes, especially those of the character shown in FIGS. 2 and 8, is non-optimum and can be removed if this is cost justifiable.

Also, it is not essential to employ chemical milling to take advantage of the present invention as other techniques such as conventional machining can be used. Typically, however, chemical milling will be preferred if the structure is being fabricated from metal because of the significantly smaller corner radii that can be made by the process. In the case of composites, the techniques conventionally utilized to fabricate structures from those materials will be employed instead of the chemical milling or machining techniques used for metals.

The invention may be embodied in specific forms in addition to those discussed above without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed by me as my invention and desired to be protected by Letters Patent of the United States is:

1. A method of making a lightweight, high strength structure from plate stock which comprises the steps of: forming said stock into a selected shape and thereafter reducing said stock to a skin having integral therewith separate arrays of primary ribs and secondary reinforcing ribs, said primary ribs and said secondary reinforcing ribs having different cross-sectional configurations.

2. A method of making a lightweight, high strength structure as defined in claim 1 wherein the plate stock is reduced to a skin having reinforcing ribs integral therewith by chemical milling.

3. A method of making a lightweight, high strength structure as defined in claim 2 wherein at least one of said arrays of ribs is generated by two chemical milling steps with the second being so carried out as to undercut the ribs as generated in the first cut and consequentially produce a section approximating that of an I-beam.

4. A method of making a lightweight, high strength structure from plate stock which comprises the steps of: forming said stock into a selected shape and thereafter reducing said stock to a skin having integral therewith separate polygonal arrays of primary ribs and secondary reinforcing ribs.

5. A method of increasing the stiffness of a structure which is composed of a thin skin stiffened with an array of primary, integral reinforcing ribs, said method including the step of incorporating secondary, integral reinforcing ribs into said structure in such a pattern that the secondary ribs are spaced midway between, and parallel to, the primary ribs.

6. A method of reducing the weight of a structure which is composed of a thin skin stiffened with an array of primary, integral reinforcing ribs, said method including the steps of increasing the spacing between said primary ribs and compensating for said increase in spacing by incorporating in the structure an array of uncapped secondary ribs, said secondary ribs being lower in height than the primary ribs.

7. A method of making a lightweight, high strength structure from plate stock which comprises the steps of: forming said stock into a selected shape and thereafter reducing said stock to a skin having integral therewith an array of tapered reinforcing ribs which are widest at midspan and narrower in width at the ends thereof.

8. A method of making a lightweight, high strength structure as defined in claim 7 wherein the plate stock is reduced to a skin having reinforcing ribs integral therewith by chemical milling.

9. A method of making a lightweight, high strength structure as defined in claim 8 wherein said array of ribs is generated by two chemical milling steps with the second being so carried out as to undercut the ribs as generated in the first cut and consequentially produce a section approximating that of an I-beam.

10. A method of making a lightweight, high strength structure as defined in claim 7 wherein said plate stock is formed into the selected shape by roll forming and seam welding.

11. A method of reducing the weight of a structure which is composed of a thin skin stiffened with an array of integral reinforcing ribs, said method including the step of employing reinforcing ribs of constant cross sectional area, each of said ribs transitioning from a capped cross sectional configuration at midspan to an uncapped, rectangular cross sectional configuration at rib end.

12. A method of reducing the weight of a structure which is composed of a thin skin stiffened with integral reinforcing ribs, said method including the step of employing in said structure reinforcing ribs which narrow in width from midspan to their ends.

13. A method of making a lightweight, high strength structure from plate stock which comprises the steps of: forming said stock into a selected shape; thereafter reducing said stock to a skin having integral therewith at least one array of intersecting reinforcing ribs; and then removing non-optimum material from said structure in the vicinity of nodes formed by intersections of said reinforcing ribs.

14. A method of making a lightweight, high strength structure as defined in claim 13 wherein the plate stock is reduced to a skin having reinforcing ribs integral therewith by chemical milling.

15. A method of making a lightweight, high strength structure as defined in claim 14 wherein said array of ribs is generated by two chemical milling steps with the second being so carried out as to undercut the ribs as generated in the first cut and consequentially produce a section approximating that of an I-beam.

16. A method of making a lightweight, high strength structure as defined in claim 13 wherein said plate stock is formed into the selected shape by roll forming and seam welding.

17. A method of reducing the weight of a structure which is composed of a thin skin stiffened with intersecting, integral reinforcing ribs, said method including the step of removing material of which the structure is fabricated from the centers of nodes formed by the intersections of the reinforcing ribs.

18. A method of reducing the weight of a structure which has a thin skin stiffened by a first array of primary ribs and a second array of secondary ribs that intersect the primary ribs, said method including the step of removing material of which the structure is formed from nodes formed by the intersections of the primary and secondary nodes.

19. A method of making a lightweight, high strength structure which has a skin stiffened with integral reinforcing ribs, said structure being fabricated from a boron/aluminum, graphite/epoxy, or graphite/polyimide composite.

20. A method of making a lightweight structure as defined in claim 19 which includes the step of stiffening said structure with separate arrays of primary and secondary reinforcing ribs.

21. A method as defined in claim 19 wherein said structure is reinforced with tapered ribs which are widest at midspan and narrower in width at the ends thereof.

22. A method as defined in claim 21 wherein said structure is reinforced with ribs which have an essentially uniform cross section from end to end thereof.

23. A method of making a lightweight structure as defined in claim 19 which includes the step of eliminating material at nodes formed by the intersections of reinforcing ribs to thereby reduce the weight of the structure.

24. A method of making a lightweight structure as defined in claim 23 wherein said structure has primary and secondary arrays of reinforcing ribs, wherein ribs of said secondary array intersect ribs of said primary array, and wherein it is nodes at intersections of the primary and secondary ribs from which material is removed to reduce the weight of the structure.

* * * * *